United States Patent [19]

Wright et al.

[11] 4,443,348

[45] Apr. 17, 1984

[54] PROTECTIVE LUBRICANT COMPOSITION

[75] Inventors: John H. Wright, Troy; Alfred H. Smith, Jr., Boston Lake, both of N.Y.

[73] Assignee: General Electric Company, Waterford, N.Y.

[21] Appl. No.: 397,811

[22] Filed: Jul. 13, 1982

[51] Int. Cl.[3] ..... C10M 1/20; C10M 1/54

[52] U.S. Cl. ..... 252/37.2; 252/40.5; 252/42

[58] Field of Search ..... 252/37.2, 40.5, 42

[56] References Cited

U.S. PATENT DOCUMENTS 2,562,829 7/1951 Sproule et al. ..... 252/37.2

3,303,129 2/1967 Johnson et al. ..... 252/37.2

*Primary Examiner*—Jacqueline V. Howard

*Attorney, Agent, or Firm*—Hedman, Gibson, Costigan and Hoare

[57] ABSTRACT

A protective lubricating composition is provided which will penetrate readily to closely fitting frictional parts but which will turn to a protective, non-migrating lubricating gel in use. Preferred embodiments may contain silicone fluids, extreme pressure compounds and surfactants, and may be combined with solvents and propellants to make a sprayable lubricant composition.

16 Claims, No Drawings

PROTECTIVE LUBRICANT COMPOSITION

This invention relates to protective lubricating compositions. More specifically, it relates to compositions which, in addition to reducing friction between moving surfaces, also exhibit good penetration between close-fitting surfaces, remain on a lubricated surface without migrating or decomposing, and protect surfaces against corrosion.

BACKGROUND OF THE INVENTION

In the last forty years, a large number of oil additives and synthetic lubricants have been developed in order to improve the performance of or replace petroleum distillates as lubricants that reduce friction and wear between machinery parts. Additives such as oxidation inhibitors, rust inhibitors, antiwear agents and detergents have been used to improve the performance of petrolubricants or to extend their range of uses.

Oxidation inhibitors, for instance, are usually organic compounds containing sulfur, nitrogen, phosphorus or alkyl phenols which block the formation of hydroperoxides and so delay the appearance of sludge, varnish and organic acids in the oil, giving the oil extended life. Detergents act to prevent high-temperature deposit of oil-insoluble compounds on the lubricated parts by adsorbing to free particles and keeping them in solution.

Synthetic lubricants have been developed for environments which are not effectively or cheaply lubricated with conventional lubricants. Silicone oils, for example, have been found especially useful at high temperatures where many petrolubricants would burn off or decompose. On the other hand, synthetics have their own drawbacks. The silicone oils, for instance, often show poor lubricity in steel-to-steel rubbing environments, and have been most useful in gears or roller bearings, where lubricity is not as great a factor in lubricant performance.

In recent years, the diminishing availability of petroleum has led to an increased interest in designing lubricants containing lesser amounts of petroleum distillates and in developing synthetic lubricants with multi-purpose capabilities. Although this interest has sparked to creation of a number of new commercial lubricants, an all-purpose lubricant having high penetration and high lubricity while offering low migration and resistance to corrosion has not been found.

SUMMARY OF THE INVENTION

It has now been discovered that a lubricant composition comprising mineral seal oil, a fatty acid soap of a metal such as lithium, sodium, aluminum, calcium, barium, etc., mineral spirits and a metal naphthanate exhibits a unique, superior combination of all the aforementioned properties. Moreover, the performance of the composition can be tailored to different lubricating needs with judicious selection of component amounts and other additives.

Accordingly, it is the object of the present invention to provide a lubricant composition that provides corrosion resistance.

It is a further object of the present invention to provide a lubricant composition which affords good penetration and will not run off lubricated surfaces in use.

It is a further object of the present invention to provide multi-purpose lubricants which contain a significant proportion of non-petroleum materials.

These and other objects are accomplished herein by a protective lubricant composition comprising:

(i) mineral seal oil;

(ii) mineral spirits;

(iii) a metal naphthenate; and (iv) a fatty acid soap of a metal.

Preferred embodiments will also include silicone fluids for added lubricity and penetrability. Most preferred features will also include extreme pressure additives such as sulfurized oil and surfactants such as an oil-soluble emulsifier.

DETAILED DESCRIPTION OF THE INVENTION

The protective lubricant compositions of the present invention are prepared by combining mineral seal oil and mineral spirits, adding a metal naphthenate followed by a fatty acid soap of a metal, applying heat if necessary to effect homogeneity, until a fluid lubricant product is obtained. This may be cut with solvents or propellants to provide a pump- or sprayable lubricant furnishing good penetration between close-fitting parts, good lubricity, corrosion resistance and resistance to run-off or migration from the lubricated area.

The term "mineral seal oil" as it is used herein is meant to cover well-known lubricating oils, mineral oils, and high boiling petroleum distillates within a boiling point range of about 270°–370° C. The term "mineral spirits" as it is used herein is meant to cover not only the low boiling petroleum fraction (boiling point range about 150°–220° C.) known conventionally as mineral spirits in the petroleum refining art, but also "white spirits", "naphthas", "low boilers", light oils, and any other combined hydrocarbon solvents or individual, normally liquid low molecular weight hydrocarbons having the solvent-like properties to harmonize or compatible-ize the action of the other ingredients contained in the lubricant compositions of the present invention as described hereinafter.

Together the mineral seal oil and mineral spirits components make up the major portion of the basic lubricant of the invention. The relative proportions are not critical and will vary with the particular lubricating needs of the user. The mineral seal oil may be viewed as a carrier oil or the base oil of the compositions. At least five parts, per hundred parts of the total composition, of the mineral spirits component are needed to effect good dispersion of the fatty acid soap. Larger proportions of the mineral spirits component affect the rate at which the compositions change from a more flowable lubricant to a non-migrating lubricant as the low boiling mineral spirits vaporize in use.

The addition of a fatty acid soap to pretroleum distillates is a well known method for forming a grease. The use of a fatty acid soap in the present invention is also used to give gel-like qualities to the present lubricant compositions, but it has been surprisingly discovered that the addition of a metal naphthenate to the petroleum fraction/metal soap gel results in a low viscosity liquid with good penetrability. As mentioned above, when the lower boiling fractions of the lubricant composition evaporate, a grease-like compound remains to continuously lubricate and protect parts and surfaces. In this way, a penetrating lubricant is achieved while the lower boiling components of the present compositions are intact, and a lubricating and protective product remains after the low boiling fractions evaporate.

The fatty acid soaps suitable for use in the present invention are fatty acid soaps of a metal such as lithium, sodium, aluminum, calcium, barium, and the like. Aluminum soaps are preferred. A commercially available examples is Alumagel®, sold by Witco Chemical Corp. The amount of soap used must be sufficient to gel the mineral seal oil component. In preferred features, from about 1.0–6.0 parts per hundred parts of the total composition have been found suitable; 2.0 parts is most preferred.

The metal naphthenates suitable in the present compositions are the same compounds which are conventionally used as driers in paint, including magnesium, calcium, cobalt, zinc, cadmium, barium and lead naphthenates. Zinc naphthenate is preferred. The metal naphthenates also lend corrosion resistance to the present compositions.

The naphthenate may be added to the composition before or after the fatty acid soap, but to avoid difficulty in mixing a gelled composition, addition of the naphthenate before the soap is preferred. Enough naphthenate must be added to maintain the lubricant composition in a fluid form after addition of the soap. In preferred embodiments, from about 2.0–10.0 parts per hundred of the total composition have been found suitable; from about 2.5–8.5 parts is most preferred.

In preferred embodiments a silicone fluid will also be added to improve penetration and lubricity. These are methyl alkyl polysiloxanes having repeated units of the formula

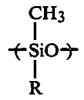

where R is $C_{(1-22)}$ alkyl. Preferred methyl alkyl silicone fluids have substituent groups of from 4 to 18 carbon atoms, that is, R in the above formula will be butyl, pentyl, hexyl, etc. Such compositions are described in U.S. Pat. No. 3,885,984, which is incorporated herein by reference.

In preparing the lubricant compositions, the petroleum distillate components, mineral seal oil and mineral spirits, are typically combined in a reaction vessel, followed by addition of the naphthenate. Heating to around 40° C. will aid in dispersing the naphthenate, which is usually a sticky, viscous material. The fatty acid soap is added, and the heating continued to around 60°–90° C. The mixture typically will thicken as the fatty acid soap goes into solution (around 50°–60° C.) and then thin with further heating. If a silicone fluid is added, it is best added after the soap in the 60°–90° C. range.

When the mixture cools to room temperature it is a concentrated lubricant which can be diluted with additional mineral spirits or solvents which would normally volatilize at the high preparation temperatures. The composition may also be combined with propellants such as propane in order to be applied by aerosol spray.

Other additives which may be added to the composition to tailor its performance to particular lubricating needs will include, for example "extreme pressure" compounds such as sulfurized oils and other well known sulfur, phosphorous and halogen containing compounds which raise the load bearing capacity of lubricants; surfactants to improve water resistance and disperse the other additives; and solvents or degreasers such as methylene chloride to act as diluents for the composition or render the composition/propellant package less flammable.

The lubricant composition of the present invention can be pumped or sprayed as a multi-purpose lubricant on metal and metal parts, or to free stuck parts, or generally wherever conventional oil lubricants are used. The compositions of the present invention will displace water from surfaces, and protect parts from wear due to friction and from corrosion. Preferred embodiments of this invention were found to out-perform the several commercial spray lubricants tested.

In order that persons skilled in the art may better understand the practice of the present invention, the following examples are provided by way of illustration, and not by way of limitation.

EXAMPLE 1

27.5 parts (by weight) of mineral seal oil (B.P. range 518°–610° F.; Union Oil Co.) and 10.0 parts of Mineral Spirits 75 (B.P. range 319°–397° F.; Union Oil Co.) and 2.0 parts of Alumagel® (aluminum soap; Witco Chemical Co.) were mixed and heated to 50° C., at which point a gel formed. 3.0 parts of zinc naphthenate were added and mixed to produce a 100 cstk. fluid. 6.0 parts of methyl alkyl polysiloxane fluid (General Electric Co.), 0.5 parts of a sulfurized oil (Base 44®; Keil Co.), and 1.0 parts of a surfactant (Arquad®2C-75; Armak Chemical Inc.) were also added. Finally, 50.0 parts of Mineral Spirits 75 were added.

The resulting lubricant composition has a Brookfield viscosity of 10 cstks. using a Brookfield RVT viscometer, 20 rpm, No. 1 spindle. Solids after heating to 140° C. for 45 minutes is about 13.5%.

Lubricity was determined on a Falex tester, which consists of two V-shaped blocks pressed on opposite sides of a rotating pin. The pin rotates at 290 rpm and the V blocks are pressed on to the pin at a steadily increasing pressure. The pressure of the V blocks is represented in pounds and the torque is measured on the pin. As the V block pressure is increased, the torque increases.

As long as the lubricating film exists on the pin, there will be no wear until the point at which the increasing pressure and torque of the V blocks forces the lubricant aside and metal-to-metal contact occurs. When this lubricant failure occurs, wear will occur but as the pressure increases torque will hold nearly constant. This is followed by a rapid increase in torque and ultimate breaking of the pin due to galling.

For the purposes of these examples, pressure and torque are measured just as the rapid increase in torque occurs, or just at the point of failure of the lubricant. A coefficient of friction is determined from these measurements using the torque divided by the block pressure times a constant for the Falex machine (2.9726). The lower the coefficient of friction, the better the lubricant. Falex tests run on steel for the above composition provided a coefficient of friction of 0.081, which compares favorably to coefficients of friction around 0.11 for other commercial materials of this type.

Steel panels coated with the lubricant composition were also tested for corrosion resistance in a salt spray cabinet. In another test, cleaned and coated panels were submersed in an aqueous 2% salt solution for 5 days, removed and washed, and examined for rust. Panels coated with the above composition showed little or no rust in either test.

EXAMPLE 2

In order to test the effect of various ingredients 12 lubricant compositions were prepared as follows:

| | Compositions | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Min. Seal Oil | 96 | 94 | 88 | 85 | 74 | 73.5 | 76 | 75.5 | 87.5 | 85.5 | 100 | |
| Alumagel ® | 4 | 4 | 4 | 4 | 4 | 4 | 4 | 4 | 4.0 | 4 | | |
| Zinc Naphthenate | | 2 | 8 | 8 | 8 | 8 | 8 | 8 | 8.0 | 8 | | |
| Span 80 ® (surfactant) | | | | 2 | 2 | 2 | | | | 2 | | |
| methyl alkyl silicone fluid | | | | | 12 | 12 | 12 | 12 | | | | 100 |
| Base 44 ® (sulfurized oil) | | | | | | 0.5 | | 0.5 | 0.5 | 0.5 | | |

The 12 compositions were tested for lubricity on a Falex tester, water displacement and corrosion resistance (2% salt solution submersion for 1 week) as in Example 1, with the following results:

| Composition | Torque | Saw Load | Coef. of Fric. | Load Factor | Lub Rank | Water Displace | Corr. Test (1-OK 10-Fail) | Corr. Rank |
|---|---|---|---|---|---|---|---|---|
| 1 | | | | Could not run - gel. | | | | |
| 2 | 15 | 500 | 0.089 | 5606 | 9-10 | no | 9 | 9 |
| 3 | 16 | 550 | 0.086 | 6360 | 7 | no | 2 | 4 |
| 4 | 16.5 | 550 | 0.089 | 6176 | 8 | yes | 1 | 1 |
| 5 | 16 | 600 | 0.079 | 7569 | 6 | yes | 2 | 2 |
| 6 | 16 | 700 | 0.068 | 10302 | 2 | yes | 2 | 3 |
| 7 | 17 | 650 | 0.078 | 8360 | 5 | sli | 7 | 8 |
| 8 | 16 | 725 | 0.066 | 11050 | 1 | sli | 5 | 7 |
| 9 | 15 | 675 | 0.066 | 10220 | 3 | no | 4 | 6 |
| 10 | 15.5 | 650 | 0.074 | 9170 | 4 | yes | 3 | 5 |
| 11 | 14 | 400 | 0.104 | 3845 | 11 | no | 10 | 11 |
| 12 | 15 | 500 | 0.089 | 5606 | 9-10 | no | 10 | 10 |

From these results, the effects of various ingredients in different combinations can be seen.

Obviously, modifications and variations in the present invention are possible in light of the foregoing disclosure. It is understood, however, that any incidental changes made in the particular embodiments of the invention as disclosed are within the full intended scope of the invention as defined by the appended claims.

We claim:

1. A protective lubricating composition comprising mineral seal oil, an amount of a fatty acid soap of a metal selected from the group consisting of lithium, sodium, barium, aluminum and calcium sufficient to gel said mineral seal oil, an amount of mineral spirits effective to disperse said fatty acid soap, and an amount of a metal naphthenate selected from the group consisting of naphthenates of magnesium, calcium, cobalt, cadmium, barium, lead and zinc sufficient to maintain the composition in fluid form in the presence of said fatty acid soap.

2. A protective lubricating composition comprising mineral seal oil, mineral spirits, a fatty acid soap of a metal selected from the group consisting of lithium, sodium, barium, aluminum and calcium, a metal naphthenate selected from the group consisting of naphthenates of magnesium, calcium, cobalt, cadmium, barium, lead and zinc, a methyl alkyl polysiloxane fluid, a compound to enhance the load bearing capacity of the composition, and a surfactant, wherein at least 5 parts mineral spirits are present per 100 parts of said composition.

3. A protective lubricating composition comprising mineral seal oil, at least 5 parts mineral spirits per 100 parts of said composition, an aluminum soap, 2-10 parts zinc naphthenate per 100 parts of said composition, a methyl alkyl polysiloxane fluid, a sulfurized oil and an oil soluble emulsifier.

4. A sprayable lubricant comprising the lubricating composition of claim 3, a solvent, and a propellant.

5. A sprayable lubricant as defined in claim 4, wherein said solvent is methylene chloride and said propellant is selected from propane and a combination of isobutane and propane.

6. A protective lubricating composition comprising, per 100 parts by weight of the total composition:

(a) 50-64 parts by weight mineral seal oil;
(b) 15-25 parts by weight mineral spirits;
(c) 3-6 parts by weight aluminum soap;
(d) 5-10 parts by weight zinc naphthenate;
(e) 8-16 parts by weight methyl alkyl polysiloxane;
(f) 0.2-1.0 parts by weight sulfurized oil; and
(g) 1-4 parts by weight oil soluble emulsifier.

7. A sprayable lubricant comprising:

(A) about 37.5 parts by weight of a lubricating composition comprising, per 100 part of said composition:
  (a) 50-64 parts by weight mineral seal oil;
  (b) 15-25 parts by weight mineral spirits;
  (c) 3-6 parts by weight aluminum soap;
  (d) 5-10 parts by weight zinc naphthenate;
  (e) 8-16 parts by weight methyl alkyl polysiloxane;
  (f) 0.2-1.0 parts by weight sulfurized oil; and
  (g) 1-4 parts by weight oil soluble emulsifier;
(B) about 37.5 parts by weight methylene chloride; and
(C) about 25.0 parts by weight of a propane propellant.

8. A composition as defined in claim 1, which additionally contains a silicone fluid.

9. A composition as defined in claim 1, which additionally contains a compound to enhance the load bearing capacity of said composition.

10. A composition as defined in claim 1, which additionally contains a surfactant.

11. A composition as defined in claim 1, wherein said mineral spirits are present in amounts of at least 5 parts per 100 parts of the total composition, said fatty acid soap is present in amounts of 1–6 parts per 100 parts of the total composition, and said metal naphthenate is present in 2–10 parts per 100 parts of the total composition.

12. A protective lubricating composition comprising:

(i) mineral seal oil;

(ii) at least 5 parts per 100 parts of the total composition mineral spirits;

(iii) 2–10 parts per 100 parts of the total composition of a metal naphthenate; and (iv) 1–6 parts per 100 parts of the total composition of a fatty acid soap of a metal.

13. A composition as defined in claim 12, wherein said fatty acid soap is of a metal selected from the group consisting of lithium, sodium, barium, aluminum, and calcium; and wherein said methyl naphthenate is selected from naphthenates of the group consisting of magnesium, calcium, cobalt, cadmium, barium, lead and zinc.

14. A composition as defined in claim 12 which additionally contains 8–16 parts per 100 parts of the total composition of a methyl alkyl polysiloxane fluid.

15. A composition as defined in claim 12 which additionally contains 0.2–1.0 parts per 100 parts of the total composition of a sulfurized oil.

16. A composition as defined in claim 12 which additionally contains 1–4 parts per 100 parts of the total composition of an oil soluble emulsifier.

* * * * *